US011851841B2

(12) United States Patent
Yonekura et al.

(10) Patent No.: US 11,851,841 B2
(45) Date of Patent: Dec. 26, 2023

(54) CONSTRUCTION MACHINE

(71) Applicant: Yanmar Power Technology Co., Ltd., Osaka (JP)

(72) Inventors: Kiyoshi Yonekura, Chikugo (JP); Keiichi Nishihara, Chikugo (JP)

(73) Assignee: YANMAR POWER TECHNOLOGY CO., LTD., Osaka (JP)

( * ) Notice: Subject to any disclaimer, the term of this patent is extended or adjusted under 35 U.S.C. 154(b) by 206 days.

(21) Appl. No.: 17/615,002

(22) PCT Filed: May 28, 2020

(86) PCT No.: PCT/JP2020/021104
§ 371 (c)(1),
(2) Date: Nov. 29, 2021

(87) PCT Pub. No.: WO2020/241746
PCT Pub. Date: Dec. 3, 2020

(65) Prior Publication Data

US 2022/0220698 A1 Jul. 14, 2022

(30) Foreign Application Priority Data

May 31, 2019 (JP) ..... 2019-102587

(51) Int. Cl.
*E02F 9/12* (2006.01)
*E02F 3/32* (2006.01)
*E02F 9/08* (2006.01)

(52) U.S. Cl.
CPC ..... *E02F 9/123* (2013.01); *E02F 9/126* (2013.01); *E02F 3/325* (2013.01); *E02F 9/0883* (2013.01)

(58) Field of Classification Search
CPC . E02F 9/123; E02F 9/126; E02F 3/325; E02F 9/0883; E02F 9/2275; E02F 9/0866; E02F 9/08; E02F 9/121
See application file for complete search history.

(56) References Cited

U.S. PATENT DOCUMENTS

2005/0210717 A1* 9/2005 Ueda ..... E02F 9/163 37/443
2006/0108309 A1* 5/2006 Sato ..... E02F 3/325 212/232

(Continued)

FOREIGN PATENT DOCUMENTS

CN 101498137 A * 8/2009 ..... E02F 9/166
JP 2001-090106 A 4/2001

(Continued)

OTHER PUBLICATIONS

Inagaki, Jun. 2017, JP-2017115422-A, Machine Translation of Specification.*

(Continued)

*Primary Examiner* — Paul N Dickson
*Assistant Examiner* — Matthew Joseph Ganci
(74) *Attorney, Agent, or Firm* — NORTON ROSE FULBRIGHT US LLP

(57) ABSTRACT

A construction machine comprises a lower traveling body, an upper turning body, and a turning frame that constitutes the bottom portion of the upper turning body. The turning frame comprises a bottom plate, a first vertical plate and a second vertical plate, and a coupling member that divides the space between the first vertical plate and the second vertical plate. The coupling member includes a top plate and a front and rear pair of a front side plate and a rear side plate that extend downward from both ends of the top plate in the front to rear direction, and forms a box shape structure with the first vertical plate and the second vertical plate. The box (Continued)

shape structure has a first opening formed in the first vertical plate, a second opening formed in the second vertical plate, and a front engine support part formed in the top plate.

4 Claims, 5 Drawing Sheets

(56) References Cited

U.S. PATENT DOCUMENTS

| | | | | |
|---|---|---|---|---|
| 2009/0211833 | A1* | 8/2009 | Lee | E02F 9/0816 180/311 |
| 2014/0145471 | A1* | 5/2014 | Shimomura | E02F 9/0816 296/193.07 |
| 2017/0016206 | A1* | 1/2017 | Ota | E02F 9/0858 |

FOREIGN PATENT DOCUMENTS

| | | | | |
|---|---|---|---|---|
| JP | 2001-271375 | A | | 10/2001 |
| JP | 2008-240353 | A | | 10/2008 |
| JP | 2011-196046 | A | | 10/2011 |
| JP | 2017-115422 | A | | 6/2017 |
| JP | 2017115422 | A | * | 6/2017 |

OTHER PUBLICATIONS

Kimura, Aug. 2009, CN-101498137-A, Machine Translation of Specification.*

International Search Report dated Aug. 18, 2020 issued in corresponding PCT Application PCT/JP2020/021104.

* cited by examiner

CONSTRUCTION MACHINE

CROSS-REFERENCE TO RELATED APPLICATIONS

This application is a national stage application pursuant to 35 U.S.C. § 371 of International Application No. PCT/JP2020/021104, filed on May 28, 2020 which claims priority under 35 U.S.C. § 119 to Japanese Patent Application No. 2019-102587 filed on May 31, 2019, the disclosures of which are hereby incorporated by reference in their entireties.

TECHNICAL FIELD

The present invention relates to a construction machine.

BACKGROUND ART

A construction machine, such as a backhoe, includes a lower traveling body, an upper turning body provided capable of turning above the lower traveling body, and a work machine that is supported vertically rotatably at the front of the upper turning body.

Patent Literature 1 discloses, as a pump suction piping structure of a construction machine, a technology for routing a suction hose by being passed through left and right vertical plates extending in a front-rear direction of the upper turning body and by being followed along a partition plate dividing the vertical plates.

In addition, Patent Literature 2 discloses, as a pump suction piping structure of a construction machine, a technology for routing a suction hose by being passed through the left and right vertical plates extending in the front-rear directions of the upper turning body, and by further being passed through the partition plate dividing the vertical plates.

In both Patent Literatures 1 and 2, since the partition plate dividing the vertical plates is a plate material, the rigidity is not sufficient and thus, when holes are drilled in the vertical plates, the rigidity needs to be ensured by increasing the thickness of the vertical plates or the like. In addition, in order to make effective use of a space in a bonnet of a small-sized construction machine, when an engine support part is to be provided on the vertical plate or the partition plate and the pump suction piping below an engine, there is a problem that strength of the engine will be insufficient.

CITATION LIST

Patent Literature 103440227.1

Patent Document 1: Japanese Unexamined Patent Application Publication No. 2001-90106

Patent Literature 2: Japanese Unexamined Patent Application Publication No. 2011-196046

DISCLOSURE OF INVENTION

Problems to be Solved by the Invention

The present invention was made in view of the above circumstances, an object of which is to provide a construction machine capable of increasing a degree of freedom of a piping layout while securing rigidity of a turning frame in the upper turning body.

Means for Solving the Problems

The construction machine of the present invention includes a lower traveling body, an upper turning body provided capable of turning above the lower traveling body, an engine disposed at a rear part of the upper turning body, and a turning frame that constitutes the bottom part of the upper turning body and on which the engine is mounted, in which the turning frame has a bottom plate, a left and right pair of a first vertical plate and a second vertical plate provided upright on the bottom plate so as to extend in the front-rear direction, and a coupling member connected to the first and second vertical plates and dividing a space between the first and second vertical plates, the coupling member includes at least a top plate and a pair of front and rear side plates extending downwardly from front and rear ends of the top plate, and forms a box shape structure together with the first vertical plate and the second vertical plate, and the box shape structure has a first opening formed through the first vertical plate, a second opening formed through the second vertical plate, and an engine support part formed in the top plate.

In the construction machine of the present invention, a third opening open to the front may be formed through the box shape structure.

In addition, the construction machine of the present invention has a hydraulic pump driven by the engine, a suction port of the hydraulic pump disposed on the left and right outer sides of the second vertical plate, and a hydraulic oil tank disposed on the left and right outer sides of the first vertical plate, and a suction hose connecting the suction port to the hydraulic oil tank may be inserted through the first and second openings.

In addition, the construction machine of the present invention also has a grease nipple disposed on the left and right outer sides of the first vertical plate and a grease supply port for a turning bearing disposed on the left and right outer sides of the second vertical plate, and a grease hose connecting the grease nipple to the grease supply port may be inserted through the second opening and the third opening.

According to the present invention, pipes such as various hoses can be routed across the turning frame in the left-right direction while passing under the engine without reducing the rigidity of the turning frame by routing the pipes by using an internal space of the box shape structure. As a result, a degree of freedom of the piping layout can be increased while securing the rigidity of the turning frame in the upper turning body.

DESCRIPTION OF EMBODIMENTS

An embodiment of the present invention will be described with reference to the drawings.

Outline of Construction Machine

Figure 1:
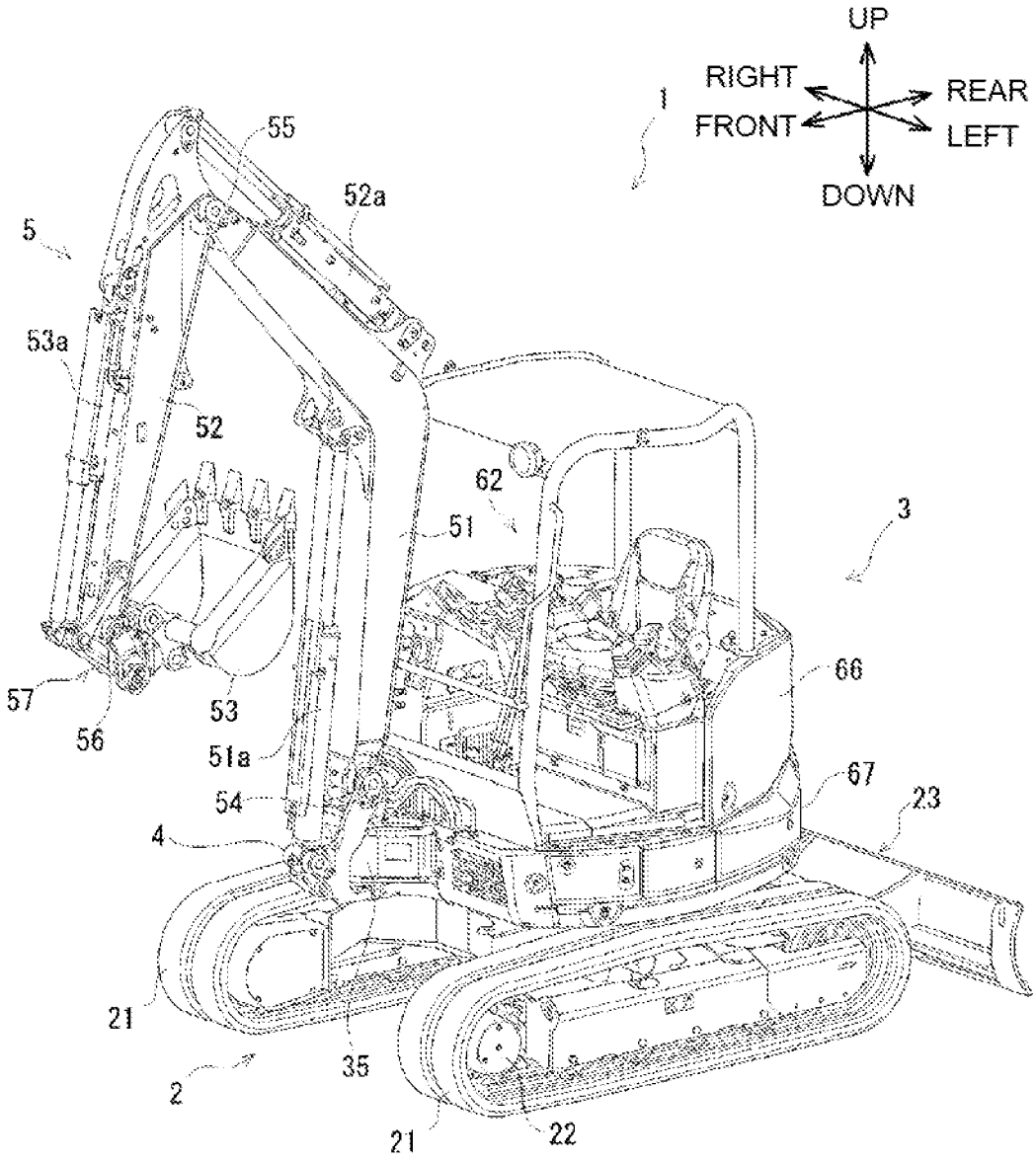
FIG. 1 is a perspective view illustrating an example of a construction machine according to the present invention.

As shown in FIG. 1, a construction machine 1 includes a lower traveling body 2, an upper turning body 3 provided capable of turning above the lower traveling body 2, a boom bracket 4 which is a swinging body supported horizontally rotatably by the upper turning body 3, and a work machine 5 which is supported vertically rotatably by the boom bracket 4. The construction machine 1 is configured as an excavator (backhoe) with a boom swing function. In general, the boom swing function is provided in a compact excavator in which workability in a narrow space is required.

The lower traveling body 2 is driven by power from an engine 60 (see FIG. 2) to travel and turn the construction machine 1. The lower traveling body 2 includes a left and right pair of crawlers 21 and 21, and a left and right pair of traveling motors 22 and 22 for driving the aforementioned crawlers 21 and 21. The lower traveling body 2 also includes a blade 23.

The upper turning body 3 is constituted capable of performing a turning operation around an axis extending in a vertical direction at a center part thereof. The upper turning body 3 has an engine 60, a turning motor 61 (see FIG. 2), a maneuvering unit 62 and the like disposed. The maneuvering unit 62 is equipped with a driver's seat and operating devices.

The boom bracket 4 is mounted at a front end of the upper turning body 3 via a mounting portion 35. The boom bracket 4 is supported by the mounting portion 35 in a horizontally rotatably (that is, laterally swingable manner). A swing cylinder (not shown), which performs an extending/contracting motion in a front-rear direction, is provided between the upper turning body 3 and the boom bracket 4. The horizontal rotation of the boom bracket 4 is performed in accordance with the extension and contraction of the swing cylinder.

The work machine 5 is driven by power from the engine 60 and performs an excavation work of earth and sand and the like in response to an operation at the maneuvering unit 62. The work machine 5 is supported on the boom bracket 4 vertically rotatably. The boom bracket 4 has a pivot pin 54 with an axis directed toward the horizontal direction provided. A base end of the work machine 5 (base end of a boom 51 described later) is supported vertically rotatably around the pivot pin 54 thereof. In addition, the work machine 5 is capable of performing a swing motion in conjunction with the horizontal rotation of the boom bracket 4.

The work machine 5 includes the boom 51, an arm 52, and a bucket 53. The boom 51 is mounted on the boom bracket 4 vertically rotatably. The boom 51 vertically extends in the vertical direction from the base end thereof supported by the boom bracket 4, and is curved in a boomerang shape in a side view. A boom cylinder 51*a*, which is movable in an extensible and contractible manner, is provided between the boom bracket 4 and an intermediate portion of the boom 51. The vertical rotation of the boom 51 with respect to the boom bracket 4 is performed in accordance with the extension and contraction of the boom cylinder 51*a*.

The arm 52 is mounted on the boom 51 vertically rotatably. A pivot pin 55 having an axis directed toward the horizontal direction is provided at a distal end of the boom 51. A base end of the arm 52 is supported vertically rotatably (rotatably back and forth) around the pivot pin 55. An arm cylinder 52*a*, which is movable in an extensible and contractible manner, is provided between an intermediate portion of the boom 51 and the base end of the arm 52. The vertical rotation of the arm 52 with respect to the boom 51 is performed in accordance with the extension and contraction of the arm cylinder 52*a*.

The bucket 53 is mounted on the arm 52 vertically rotatably. A pivot pin 56 having an axis directed toward the horizontal direction is provided at a distal end of the arm 52. A base end of the bucket 53 is supported capable of vertical rotation (back and forth rotation) around the pivot pin 56. A bucket link 57 is interposed between the distal end of the arm 52 and the bucket 53. The bucket link 57 is configured as a link for transmitting a driving force to the bucket 53. A bucket cylinder 53*a*, which is movable in an extensible and contractible manner, is provided between the bucket link 57 and the base end of the arm 52. The vertical rotation of the bucket 53 with respect to the arm 52 is performed in accordance with the extension and contraction of the bucket cylinder 53*a*.

Figure 2:
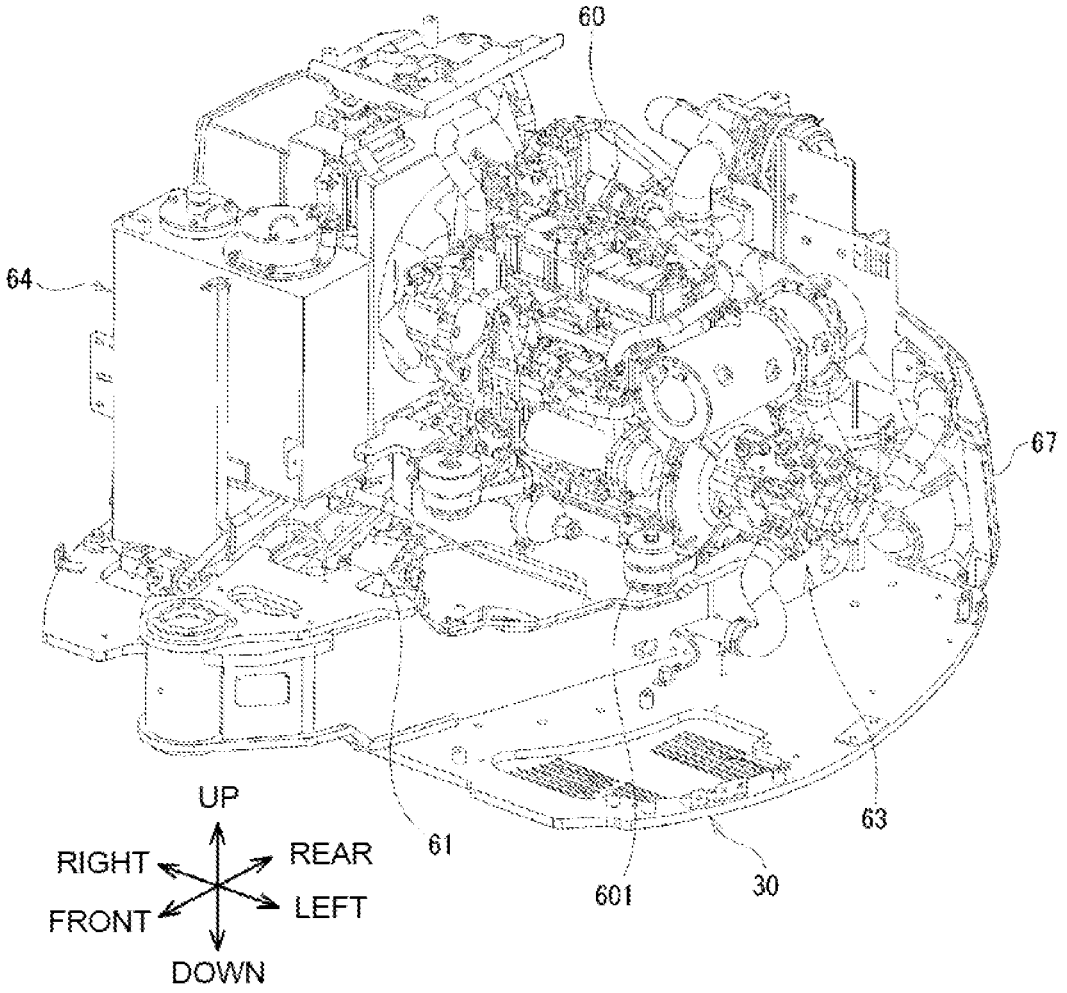
FIG. 2 is a perspective view illustrating an internal structure of an upper turning body.
Figure 3A:
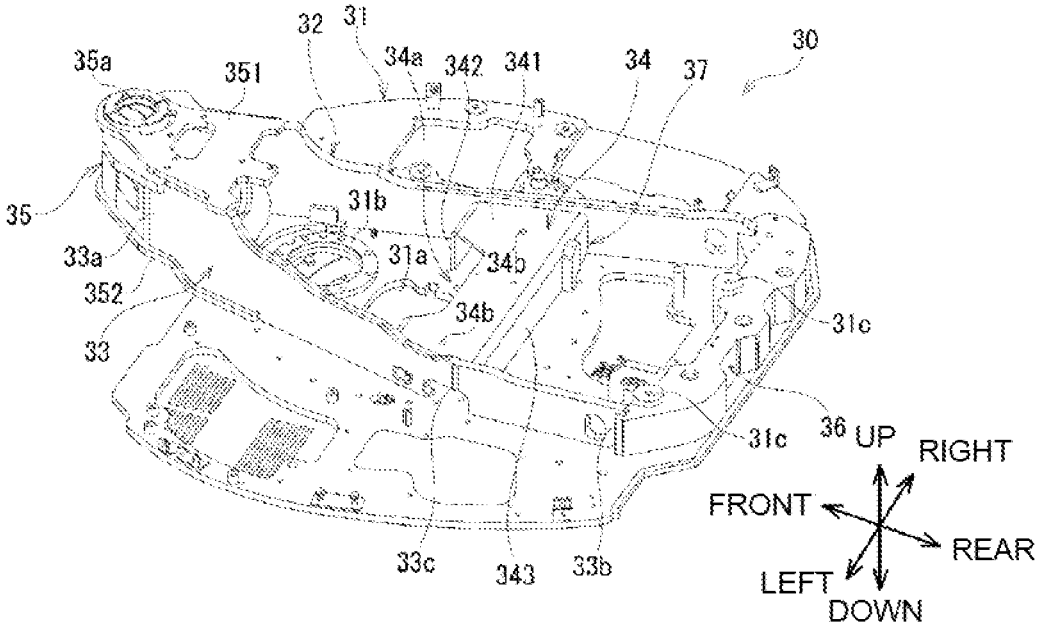
FIG. 3A and 3B are perspective view illustrating a turning frame.
Figure 3B:
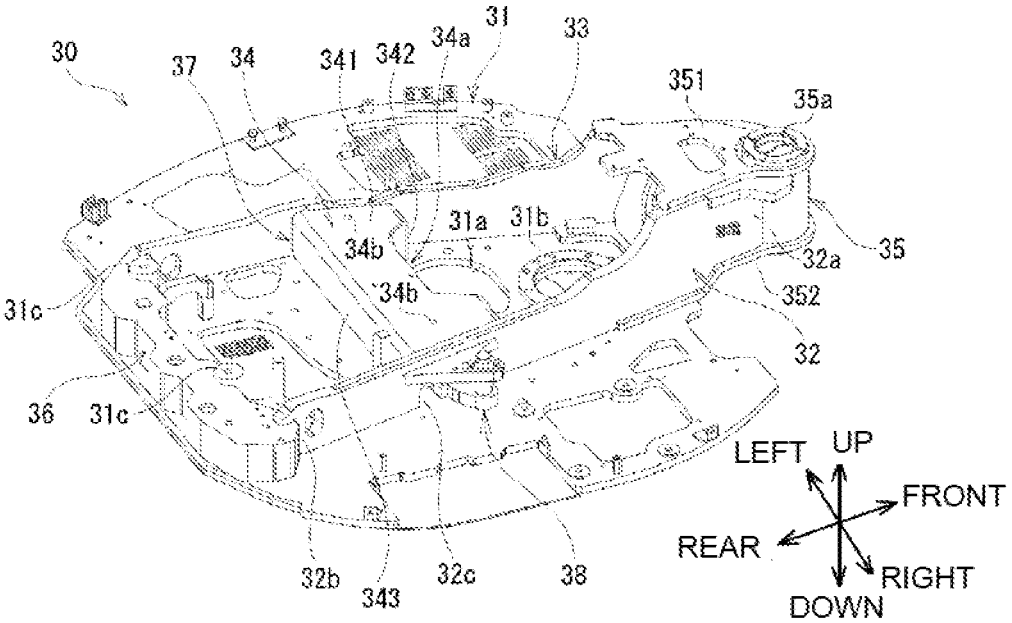

FIG. 2 is a perspective view illustrating an internal structure of the upper turning body 3. In the upper turning body 3, the engine 60, a battery, a fuel tank and the like are placed on a turning frame 30, these are covered by a bonnet 66, and the maneuvering unit 62 is disposed at the front thereof. A hydraulic pump 63 is connected to the engine 60, and the hydraulic pump 63 is driven by the engine 60 and discharges the hydraulic oil.

The hydraulic oil discharged from the hydraulic pump 63 is supplied to the swing cylinder, the boom cylinder 51*a*, the arm cylinder 52*a*, the bucket cylinder 53*a*, a blade cylinder, the traveling motors 22, 22, the turning motor 61 and the like via hydraulic hoses, the control unit and the like The turning frame 30 includes a flat plate-shaped bottom plate 31, a left and right pair of a first vertical plate 32 and a second vertical plate 33 provided upright on the bottom plate 31 so as to extend in the front-rear direction, and a coupling member 34 connected to the first vertical plate 32 and the second vertical plate 33 and dividing a space between the first vertical plate 32 and the second vertical plate 33.

The bottom plate 31 is circular with the front end cut out in the left-right direction on a plan view. The first vertical plate 32 and the second vertical plate 33 are located on the bottom plate 31 at an interval in the left-right direction, and are provided upright so as to extend in the front-rear direction. The first vertical plate 32 and the second vertical plate 33 are disposed to expand rearwardly. The first vertical plate 32 is disposed on the right side of the turning frame 30 from the center in the left-right direction, and the second vertical plate 33 is disposed on the left side of the turning frame 30 from the center in the left-right direction. The bottom plate 31 between the first vertical plate 32 and the second vertical plate 33 has a joint opening 31*a* into which a swivel joint is inserted and a motor mounting portion 31*b* for mounting the turning motor 61. In addition, a plurality of other openings for drainage and maintenance are formed through the bottom plate 31.

The first vertical plate 32 and the second vertical plate 33 have their lower edges welded to the upper surface of the bottom plate 31. A front end 32*a* of the first vertical plate 32 and a front end 33*a* of the second vertical plate 33 protrude forward from the bottom plate 31 and constitute a part of the mounting portion 35. A rear end 32*b* of the first vertical plate 32 and a rear end 33*b* of the second vertical plate 33 are connected to a counterweight mounting portion 36. The counterweight mounting portion 36 is provided on a rear end of the bottom plate 31 along the left-right direction, and a counterweight 67 is mounted on the counterweight mounting portion 36.

The coupling member 34 is connected to the first vertical plate 32 and the second vertical plate 33 behind the joint opening 31*a*. The coupling member 34 has a top plate 341 disposed along the horizontal direction and a pair of a front side plate 342 and a rear side plate 343 extending downwardly from the both ends in the front-rear direction of the top plate 341. The lower ends of the front side plate 342 and the rear side plate 343 are fixed to the bottom plate 31, and the front side plate 342 and the rear side plate 343 stand upright with respect to the bottom plate 31. That is, the coupling member 34 having a substantially U-shaped cross section with the lower side open forms a box shape structure 37 together with the bottom plate 31, the first vertical plate 32, and the second vertical plate 33.

A first opening 32*c* is formed in the first vertical plate 32. The first opening 32*c* is formed by being notched on the lower part of the first vertical plate 32. The first opening 32*c* is formed on the right side of the coupling member 34 and is connected to an internal space of the coupling member 34.

A second opening 33*c* is formed through the second vertical plate 33. The second opening 33*c* is formed by being notched on the lower part of the second vertical plate 33. The second opening 33*c* is formed on the left side of the coupling member 34 and is connected to the internal space of the coupling member 34.

A third opening 34*a* open to the front is formed through the coupling member 34. The third opening 34*a* is formed by being notched from the front side plate 342 to the top plate 341.

The top plate 341 of the coupling member 34 has a front engine support part 34*b* on which an engine mount 601 (see FIG. 2) is mounted. The front engine support parts 34*b* are formed on the right and left sides of the top plate 341, respectively. In addition, at the rear part of the bottom plate 31 and in front of the counterweight mounting portion 36, a pair of rear engine support parts 31*c* and 31*c* on which the engine mount 601 is mounted are provided, and the engine 60 is supported by the front engine support part 34*b* and the rear engine support part 31*c*.

At the front end of the turning frame 30, a mounting portion 35 on which the boom bracket 4 is mounted is provided so as to protrude forward. The mounting portion 35 has a tapered shape on a plan view, and an insertion hole 35*a* through which a pivot pin, not shown, is inserted is opened in the vertical direction at the front end thereof. The mounting portion 35 includes a pair of upper and lower stays 351, 352 spaced apart from each other. The pair of stays 351, 352 sandwich the front end 32*a* of the first vertical plate 32 and the front end 33*a* of the second vertical plate 33 from above and below. The lower stay 352 is attached to the front upper surface of the bottom plate 31 and protrudes forward from the front end of the bottom plate 31.

A swing cylinder, not shown, is disposed along the front-rear direction on the right side of the first vertical plate 32.

In the swing cylinder, a cylinder tube is rotatably supported by a cylinder mounting portion 38 formed in the turning frame 30, and a cylinder rod is rotatably connected to the boom bracket 4. By extending and contracting the cylinder rod, the boom bracket 4 can be rotationally moved to the left and right. Accordingly, the swing cylinder swings left and right around the cylinder mounting portion 38.

A control unit, not shown, is disposed on the left side of the second vertical plate 33. The control unit has control valves that control operations of hydraulic cylinders (swing cylinder, boom cylinder 51*a*, arm cylinder 52*a*, bucket cylinder 53*a*, blade cylinder) and hydraulic motors (traveling motor 22, 22, turning motor 61) disposed.

Figure 4:
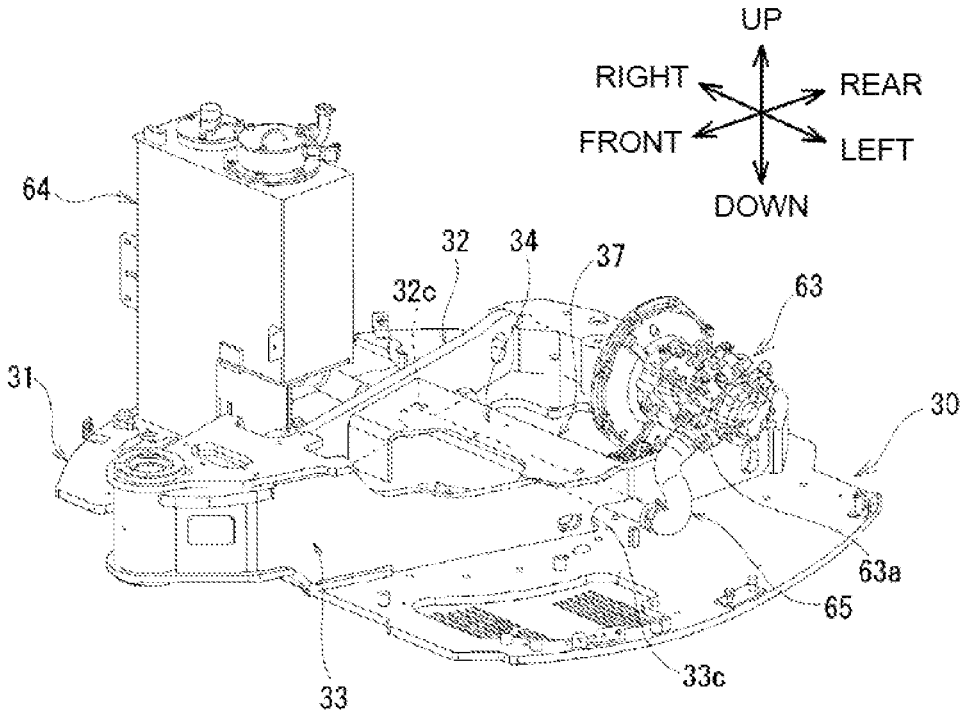
FIG. 4 is a perspective view illustrating a routing structure of a suction hose.

As shown in FIG. 4, a hydraulic oil tank 64 is disposed on the right side of the first vertical plate 32. The hydraulic oil tank 64 stores the hydraulic oil of the hydraulic pump 63 and is connected to the hydraulic pump 63 by a suction hose 65. The hydraulic oil tank 64 is disposed at the center part in the front-rear direction of the right end of the turning frame 30. The lower end of the hydraulic oil tank 64 is fixed to the bottom plate 31.

The hydraulic pump 63 includes a suction port 63*a* on the left side of the second vertical plate 33 on a plan view. One end of the suction hose 65 is connected to the lower part of the rear surface of the hydraulic oil tank 64, and the other end of the suction hose 65 is connected to the suction port 63*a*.

The suction hose 65 is disposed to cross the turning frame 30 in the left-right direction through the inside of the box shape structure 37 disposed below the engine 60. In other words, the suction hose 65 runs from the hydraulic oil tank 64 through the box shape structure 37 to the hydraulic pump 63.

At this time, the suction hose 65 is inserted through the first opening 32*c* and the second opening 33*c*.

Figure 5:
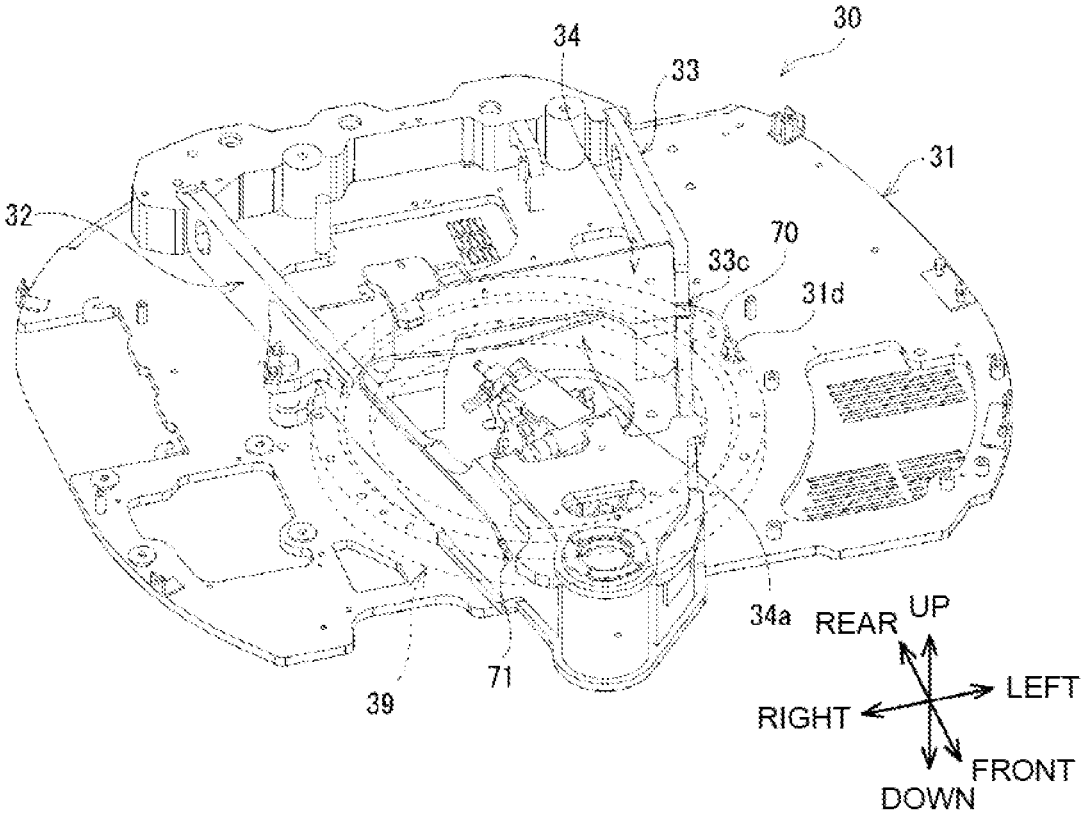
FIG. 5 is a perspective view illustrating a routing structure of a grease hose.

The upper turning body 3 turns with respect to the lower traveling body 2 via a turning bearing 39 (shown in dashed lines in FIG. 5). The turning bearing 39 is fixed to the bottom surface of the turning frame 30. A grease supply port 31*d* for the turning bearing is provided on the bottom plate 31 of the turning frame 30. The grease supply port 31*d* is formed on the left side of the second vertical plate 33.

A grease hose 70 for supplying grease to the grease supply port 31*d* is inserted through the second opening 33*c* and the third opening 34*a* to a grease nipple 71 disposed on the right side of the first vertical plate 32. The grease injected from the grease nipple 71 reaches the grease supply port 31*d* via the grease hose 70 and is supplied to the turning bearing 39.

As described above, the construction machine body 1 of the present embodiment includes the lower traveling body 2, the upper turning body 3 provided capable of turning above the lower traveling body 2, the engine 60 disposed at the rear of the upper turning body 3, the turning frame 30 constituting the bottom part of the upper turning body 3 and on which the engine 60 is mounted, the turning frame 30 includes the bottom plate 31, the left and right pair of the first vertical plate 32 and the second vertical plate 33 provided upright on the bottom plate 31 so as to extend in the front-rear direction, and the coupling member 34 connected to the first vertical plate 32 and the second vertical plate 33 and dividing the space between the first vertical plate 32 and the second vertical plate 33, the coupling member 34 includes at least the top plate 341 and the front and rear pair of the front side plate 342 and the rear side plate 343 extending downwardly from the both ends in the front-rear direction of the top plate 341, and forms the box shape structure 37 together with the first vertical plate 32 and the second vertical plate 33, and the box shape structure 37 has the first opening 32*c* formed through the first vertical plate 32, the second opening 33*c* formed through the second vertical plate 33, and the front engine support part 34*b* formed in the top plate 341.

According to this configuration, the space between the first vertical plate 32 and the second vertical plate 33 of the turning frame 30 is divided by the box shape structure 37, and the pipes can be routed across the turning frame 30 in the left-right direction while passing under the engine 60 without reducing the rigidity of the turning frame 30 by routing the pipes such as various hoses by using the internal space of the box shape structure 37. As a result, a degree of freedom of the piping layout can be increased while securing the rigidity of the turning frame 30 in the upper turning body 3. This is particularly useful for a small-sized construction machine with a narrow space inside the bonnet 66.

The box shape structure 37 preferably has the third opening 34*a* which is open to the front formed.

By providing the third opening 34*a* in front of the box shape structure 37, devices isolated by the first vertical plate 32 and the second vertical plate 33 can be connected with a greater degree of freedom.

The construction machine 1 also includes the hydraulic pump 63 driven by the engine 60, the suction port 63*a* of the hydraulic pump 63 disposed on the left side of the second vertical plate 33, and the hydraulic oil tank 64 disposed on the right side of the first vertical plate 32, and the suction hose 65 connecting the suction port 63*a* and the hydraulic oil tank 64 is preferably inserted through the first opening 32*c* and the second opening 33*c*.

According to this configuration, the length of the suction hose 65 can be shortened and conduit resistance (suction resistance) can be reduced because the suction hose 65 and the like can be routed across the turning frame 30 in the left-right direction while passing under the engine 60.

The conventional suction hose extends from the hydraulic oil tank 64 via the rear of the engine 60 to the hydraulic pump 63 and is located near an oil pan of the engine 60. According to the construction machine 1 of the present embodiment, the space behind the engine 60 can be expanded, so that a passage for cooling air can be secured. As a result, a flow of cooling air can flow more easily and cool the oil pan, which contributes to the heat balance of the engine 60.

The construction machine 1 also includes the grease nipple 71 disposed on the right side of the first vertical plate 32, the grease supply port 31*d* for the turning bearing disposed on the left side of the second vertical plate 33, and the grease hose 70 connecting the grease nipple 71 to the grease supply port 31*d* is preferably inserted through the second opening 33*c* and the third opening 34*a*.

By providing the third opening 34*a* in front of the box shape structure 37, the grease hose 70 can be used to connect the grease nipple 71 and the grease supply port 31*d* isolated by the first vertical plate 32 and the second vertical plate 33 in an optimal route.

The present invention is not limited to the above-described embodiment in any way, and various improvements and changes can be made within the scope not departing from the purpose of the present invention.

DESCRIPTION OF REFERENCE NUMERALS

1 Construction machine
2 Lower traveling body
3 Upper turning body
4 Boom bracket
5 Work machine
30 Turning frame
31 Bottom plate
31*d* Grease supply port
32 First vertical plate
32*c* First opening
33 Second vertical plate
33*c* Second opening
34 Coupling member
34*a* Third opening
341 Top plate
342 Front side plate
343 Rear side plate
37 Box shape structure
39 Turning bearing
60 Engine
63 Hydraulic pump
63*a* Suction port
64 Hydraulic oil tank
65 Suction hose
70 Grease hose
71 Grease nipple

The invention claimed is:

1. A construction machine comprising:
a lower traveling body;
an upper turning body provided capable of turning above the lower traveling body;
an engine located at a rear part of the upper turning body; and
a turning frame that constitutes a bottom part of the upper turning body and on which the engine is mounted,
wherein
the turning frame has a bottom plate, a left and right pair of a first vertical plate and a second vertical plate provided upright on the bottom plate so as to extend in a front-rear direction, and a coupling member connected to the first vertical plate and the second vertical plate and dividing a space between the first vertical plate and the second vertical plate,
the coupling member includes at least a top plate and a pair of front and rear side plates extending downwardly from both ends in the front-rear direction of the top plate, and forms a box shape structure together with the first vertical plate and the second vertical plate, and
the box shape structure has a first opening formed through the first vertical plate, a second opening formed through the second vertical plate, and an engine support part formed in the top plate.

2. The construction machine according to claim 1, wherein the box shape structure has a third opening open to front.

3. The construction machine according to claim 1 or 2, further comprising:
a hydraulic pump driven by the engine;
a suction port of the hydraulic pump disposed on left and right outer sides of the second vertical plate; and
a hydraulic oil tank disposed on left and right outer sides of the first vertical plate,
wherein a suction hose connecting the suction port to the hydraulic oil tank is inserted through the first opening and the second opening.

4. The construction machine according to claim 2, further comprising:
a grease nipple disposed on left and right outer sides of the first vertical plate; and
a grease supply port for a turning bearing disposed on left and right outer sides of the second vertical plate, wherein
a grease hose connecting the grease nipple to the grease supply port is inserted through the second opening and the third opening.

* * * * *